US010549890B1

(12) United States Patent
Felber

(10) Patent No.: US 10,549,890 B1
(45) Date of Patent: Feb. 4, 2020

(54) STORAGE CONTAINER

(71) Applicant: Felber Design, Inc., Pewaukee, WI (US)

(72) Inventor: Randy Felber, Pewaukee, WI (US)

( * ) Notice: Subject to any disclaimer, the term of this patent is extended or adjusted under 35 U.S.C. 154(b) by 0 days.

(21) Appl. No.: 16/050,317

(22) Filed: Jul. 31, 2018

Related U.S. Application Data

(60) Provisional application No. 62/690,990, filed on Jun. 28, 2018.

(51) Int. Cl.
*B65D 43/02* (2006.01)

(52) U.S. Cl.
CPC ..... *B65D 43/0206* (2013.01); *B65D 43/0216* (2013.01)

(58) Field of Classification Search
CPC ..... B65D 2543/00731; B65D 2543/00092; B65D 2543/00296
USPC ..... 220/783
See application file for complete search history.

(56) References Cited

U.S. PATENT DOCUMENTS 2,061,610 A 11/1935 Burnette
4,863,054 A 9/1989 Capetta
5,261,551 A * 11/1993 Watt ..... B65D 43/0212 220/319
6,588,618 B1 * 7/2003 Davis ..... B44D 3/127 220/254.7
D496,560 S * 9/2004 Lerner ..... D7/629
7,097,069 B2 * 8/2006 Cavanagh ..... B65D 7/04 206/217
2003/0141311 A1 * 7/2003 Ceolin ..... B65D 43/0206 220/701
2004/0144781 A1 * 7/2004 Dees ..... B65D 11/188 220/4.24
2011/0036804 A1 * 2/2011 Letica ..... B44D 3/127 215/326
2014/0054308 A1 * 2/2014 Lam ..... B65D 21/0222 220/782

FOREIGN PATENT DOCUMENTS

WO WO-2018026839 A1 * 2/2018 ..... B65D 21/0222

* cited by examiner

*Primary Examiner* — Shawn M Braden
(74) *Attorney, Agent, or Firm* — Donald J. Ersler

(57) ABSTRACT

A storage container preferably includes a container portion and a lid. The container portion preferably includes a bottom wall, a vertical peripheral wall and a female peripheral sealing cavity. The vertical peripheral wall extends upward from an outer perimeter of the bottom wall. The female peripheral sealing cavity extends around an entire perimeter of the vertical peripheral wall. The lid includes a top wall and a male peripheral sealing projection. The male peripheral sealing projection includes a partially curved cross section, which is sized to be sealingly received by the female peripheral sealing cavity. A top inner perimeter of the male peripheral sealing projection extends from an outer perimeter of the top wall. The male peripheral sealing projection extends around an entire perimeter of the top wall. The shape of the lid and storage portion preferably include a substantially rectangular shape with four curved corners.

7 Claims, 4 Drawing Sheets

STORAGE CONTAINER

CROSS-REFERENCES TO RELATED APPLICATIONS

This is a utility patent application, which claims the benefit of provisional application no. 62/690,990 filed on Jun. 28, 2018.

BACKGROUND OF THE INVENTION

1. Field of the Invention

The present invention relates generally to storage devices and more specifically to a storage container, which includes a unique sealing arrangement.

2. Discussion of the Prior Art

U.S. Pat. No. 2,061,610 to Burnette discloses a combination skillet structure. U.S. Pat. No. 4,863,054 to Capetta discloses an amusement game display container. However, it appears that the prior art does not teach or suggest a non-metal storage container, which includes a female peripheral sealing cavity with a curved cross section and which includes a portion of an inner surface of the female peripheral sealing cavity sharing an outer surface of a vertical wall of a container portion of the storage container. The design of the storage container sealing structure prevents dirty water from collecting in a bottom of the sealing rim of the storage portion, because a material filet is substituted for a peripheral cavity. Prior art storage containers have the sealing rims in an opposite direction of the present invention.

Accordingly, there is a clearly felt need in the art for a storage container, which includes a top inner surface of a female peripheral sealing cavity, which is the same as an outer surface of a top of the vertical peripheral wall of a container portion of the storage container.

SUMMARY OF THE INVENTION

The present invention provides a storage container, which includes a unique sealing arrangement. The storage container preferably includes a container portion and a lid. The container portion preferably includes a bottom wall, a vertical peripheral wall and a female peripheral sealing cavity. The vertical peripheral wall extends upward from an outer perimeter of the bottom wall. The female peripheral sealing cavity includes a partially curved cross section. The female peripheral sealing cavity extends around an entire perimeter of the vertical peripheral wall. A top inner surface of the female peripheral sealing cavity is the same as an outer surface of a top of the vertical peripheral wall of the container portion. A material filet joins an inner portion of an outer surface of the female peripheral sealing cavity to the top of the vertical peripheral wall. The vertical peripheral wall is preferably tapered, such that a smallest perimeter dimension is at a bottom of the vertical peripheral wall and the largest perimeter dimension is at a top of the vertical peripheral wall. The shape of the container portion preferably includes a substantially rectangular shape with four curved corners.

The lid includes a top wall and a male peripheral sealing projection. The male peripheral sealing projection includes a partially curved cross section, which is sized to be sealingly received by the female peripheral sealing cavity. A top inner perimeter of the male peripheral sealing projection extends from an outer perimeter of the top wall of the lid. The male peripheral sealing projection extends around an entire perimeter of the top wall. The shape of the lid preferably includes a substantially rectangular shape with four curved corners. At least one lift tab preferably extends from a corner of a top outer edge of the male peripheral sealing projection.

Accordingly, it is an object of the present invention to provide a storage container, which includes a top inner surface of a female peripheral sealing cavity, which is the same as an outer surface of a top of the vertical peripheral wall of a container portion of the storage container.

These and additional objects, advantages, features and benefits of the present invention will become apparent from the following specification.

DETAILED DESCRIPTION OF THE PREFERRED EMBODIMENTS

Figure 1:
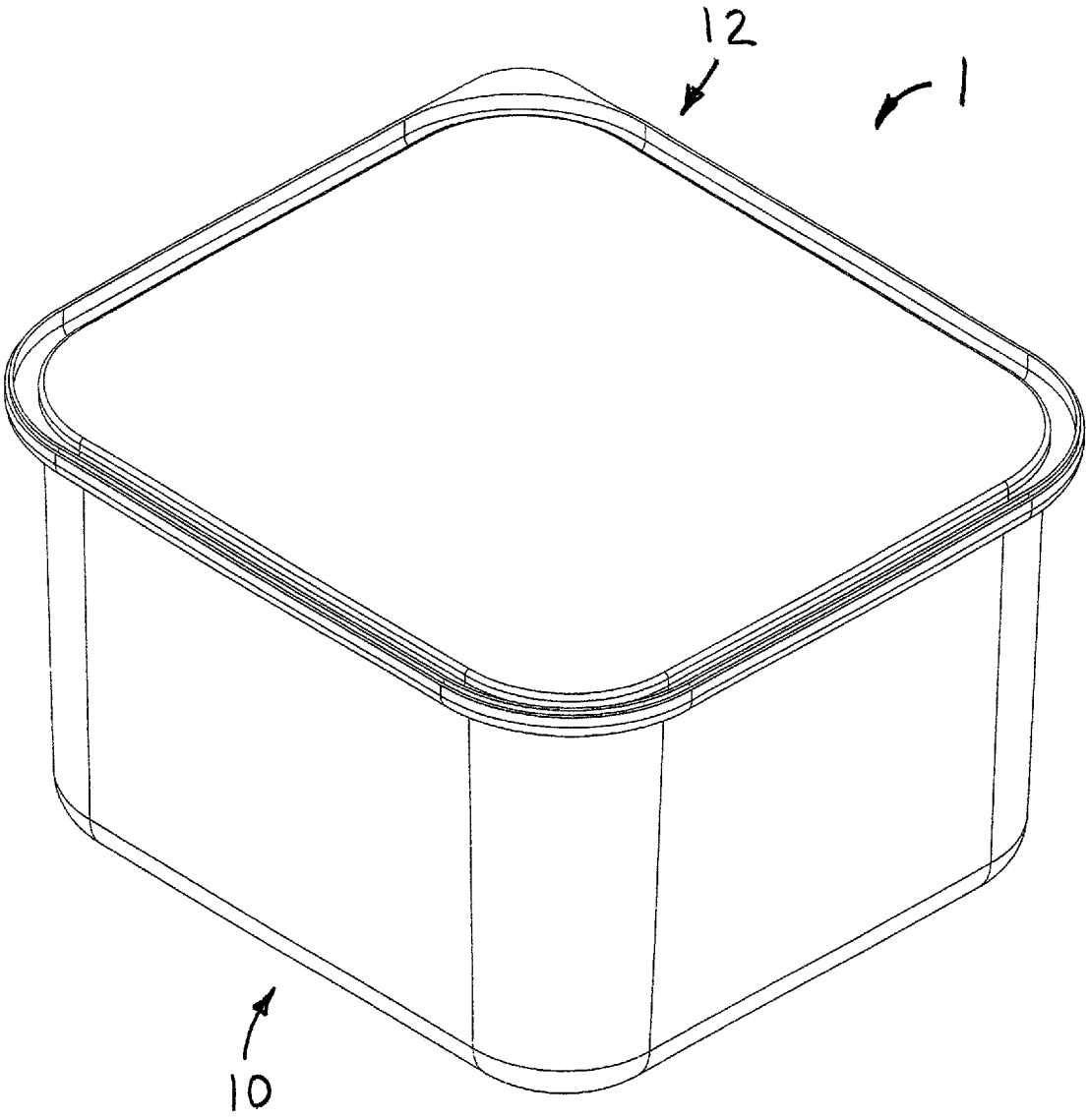
FIG. 1 is a perspective view of a storage container in accordance with the present invention.
Figure 2:
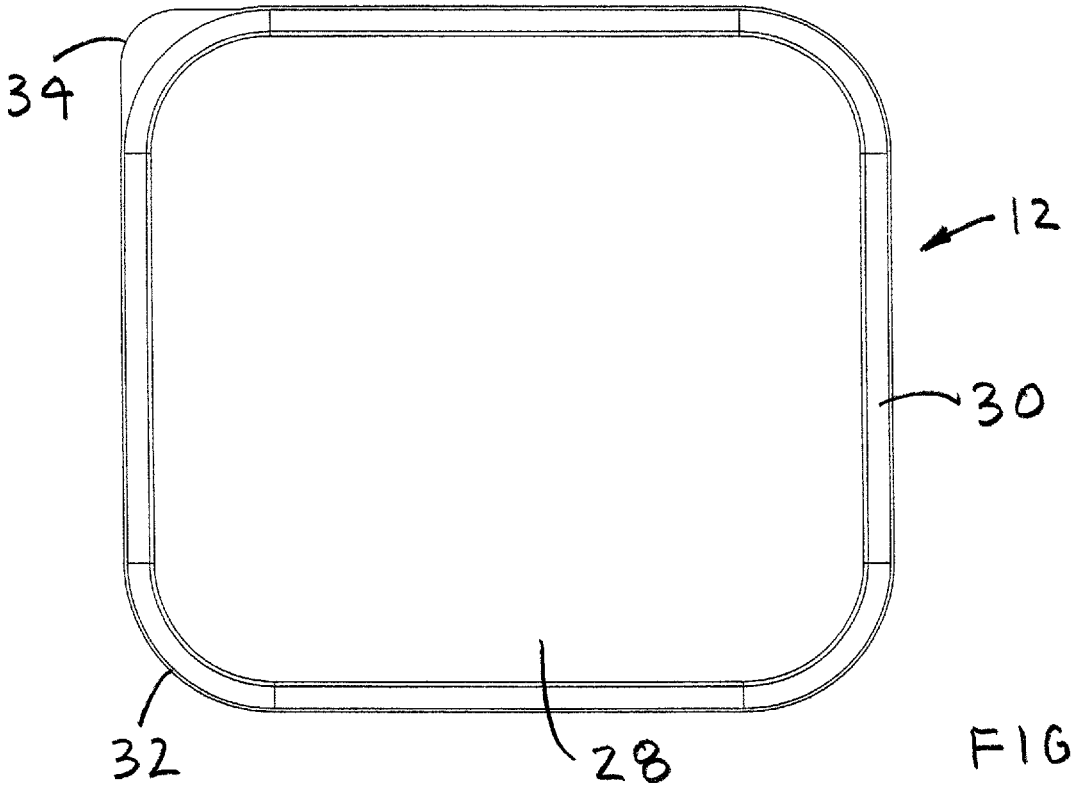
FIG. 2 is a top view of a lid of a storage container in accordance with the present invention.
Figure 3:
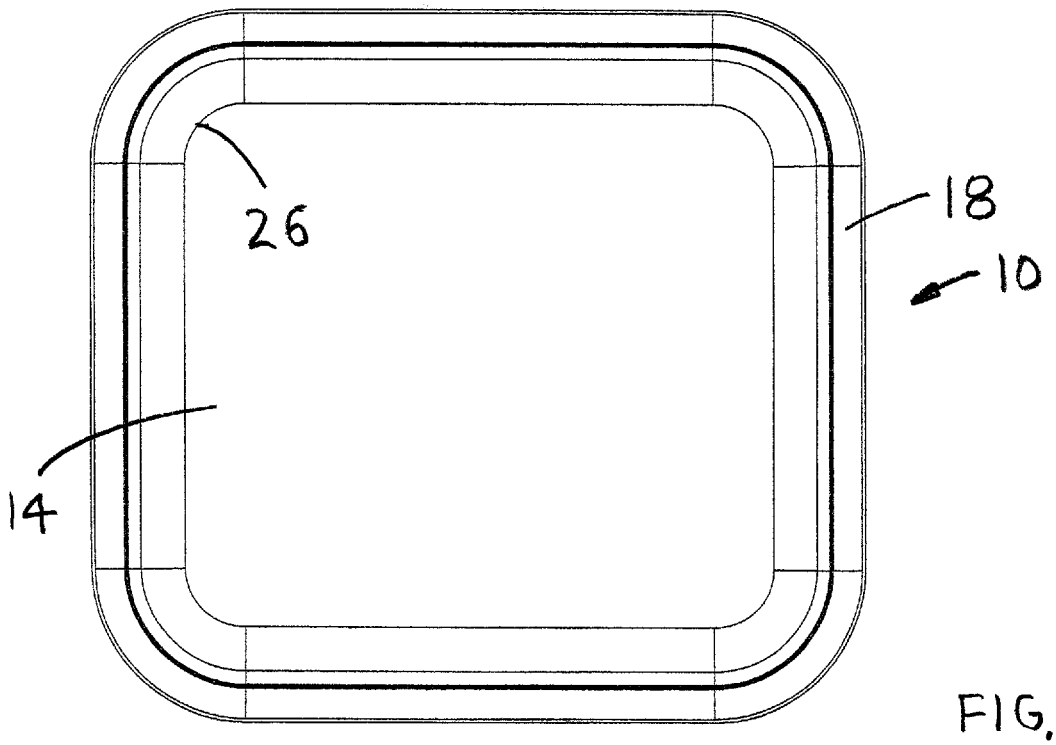
FIG. 3 is a top view of a container portion of a storage container in accordance with the present invention.
Figure 4:
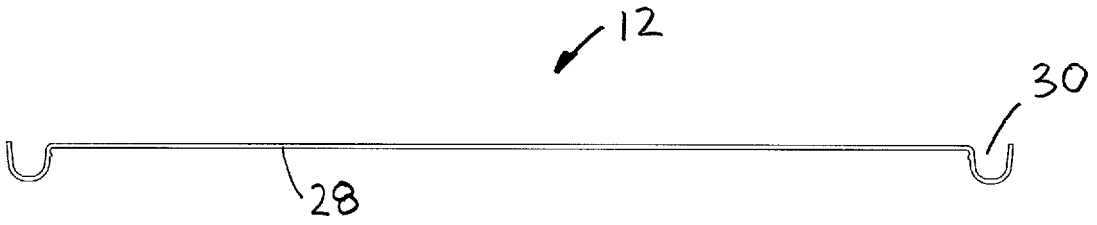
FIG. 4 is a cross sectional view of a lid of a storage container in accordance with the present invention.
Figure 5:
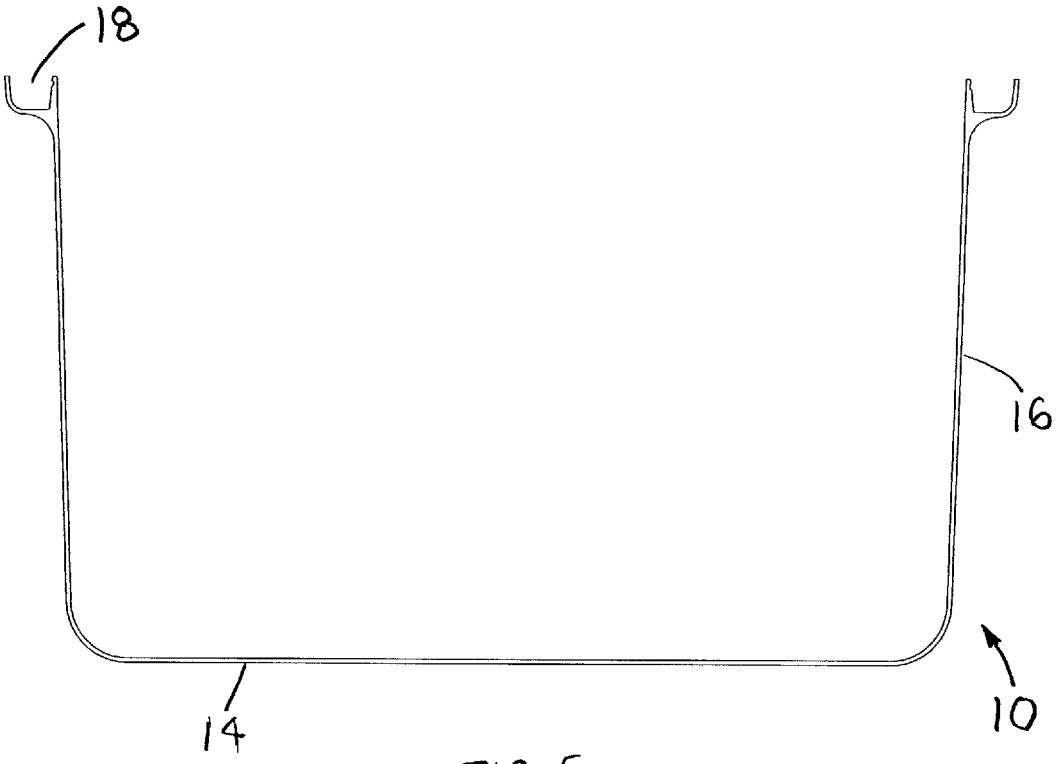
FIG. 5 is a cross sectional view of a container portion of a storage container in accordance with the present invention.
Figure 6:
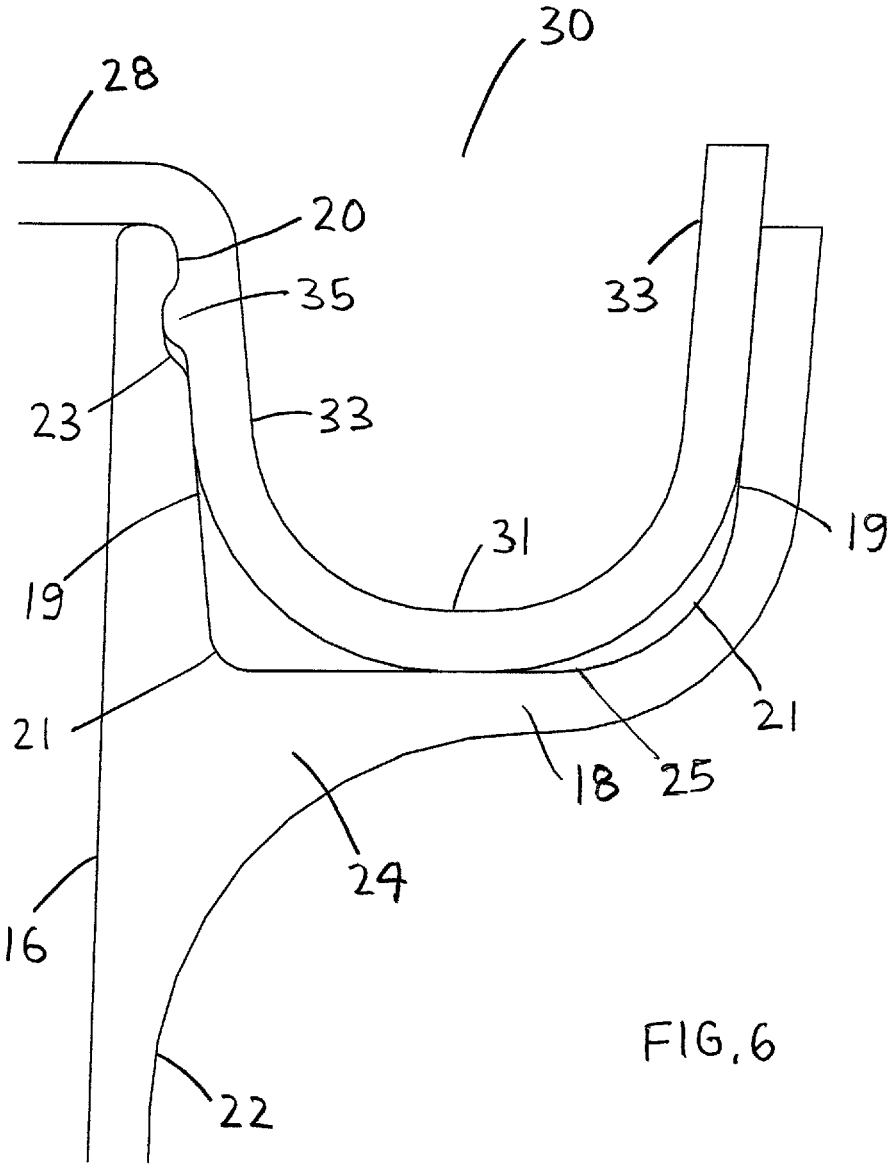
FIG. 6 is an enlarged cross sectional view of a male peripheral sealing projection of a lid inserted into a female peripheral sealing cavity of a container portion of a storage container in accordance with the present invention.

With reference now to the drawings, and particularly to FIG. 1, there is shown a perspective view of a storage container 1. The storage container 1 preferably includes a container portion 10 and a lid 12. With reference to FIGS. 2-6, the container portion 10 preferably includes a bottom wall 14, a vertical peripheral wall 16 and a female peripheral sealing cavity 18. The vertical peripheral wall 16 extends upward from an outer perimeter of the bottom wall 14. The female peripheral sealing cavity 18 preferably includes opposing tapered walls 19, curved inner corners 21 and a peripheral retention cavity 23. The curved inner corners 21 extend outward from opposing ends of a bottom surface 25. The opposing tapered walls 19 extend upward from the curved inner corners 21. The retention cavity 23 is formed in an inner surface of the tapered wall 19 near a top of the vertical peripheral wall 16. The female peripheral sealing cavity 18 extends around an entire perimeter of the vertical peripheral wall 16. A top inner surface 20 of the female peripheral sealing cavity 18 is the same as an outer surface 22 of a top of the vertical peripheral wall 16 of the container portion 10. A material filet 24 joins an outer surface of the female peripheral sealing cavity 18 to the top of the vertical peripheral wall 16. The vertical peripheral wall 16 is preferably tapered, such that a smallest perimeter dimension is at a bottom of the vertical peripheral wall 16 and the largest perimeter dimension is at a top of the vertical peripheral wall 16. The shape of the container portion 10 preferably includes a substantially rectangular shape with four curved corners 26.

The lid 12 includes a top wall 28 and a male peripheral sealing projection 30. The male peripheral sealing projection 30 preferably includes a curved bottom 31, opposing tapered walls 33 and a peripheral retention projection 35. The pair of opposing tapered walls 33 extend upward from opposing ends of the curved bottom 31. The peripheral retention projection 35 extends outward from an outer surface of an inner tapered wall 33 near the top wall 28. The peripheral retention projection 35 snaps into the peripheral retention cavity 23, when the male peripheral sealing projection 30 is fully inserted into the female peripheral sealing cavity 18. A top inner perimeter of the male peripheral sealing projection 30 extends from an outer perimeter of the top wall 28. The male peripheral sealing projection 30 extends around an entire perimeter of the top wall 28. The male peripheral sealing projection 30 is sized to be sealingly received by the female peripheral sealing cavity 18. The shape of the lid 12 preferably includes a substantially rectangular shape with four curved corners 32. At least one lift tab 34 preferably extends from one corner 32 of a top outer edge of the male peripheral sealing projection 30. The container portion 10 and the lid 12 are fabricated from a non-metal material, such as plastic.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A storage container comprising:

a container portion includes a bottom wall, a vertical peripheral wall and a female peripheral sealing cavity, said vertical peripheral wall extends upward from an outer perimeter of said bottom wall, a top inner surface of said female peripheral sealing cavity is the same as an outer surface of a top of said vertical peripheral wall of said container portion, a material filet joins an outer surface of said female peripheral sealing cavity to a top of said vertical peripheral wall; and a lid includes a top wall and a male peripheral sealing projection, said male peripheral sealing projection includes a first wall, a projection bottom wall and a second wall, a top of said first wall extends downward from a perimeter of said top wall, said projection bottom wall extends outward from a bottom of said first wall, said second wall extends upward from a perimeter of said projection bottom wall, wherein said male peripheral sealing projection is sized to be sealingly received by said female peripheral sealing cavity.

2. The storage container of claim 1 wherein:

a female peripheral sealing cavity extends around an entire perimeter of said vertical peripheral wall at a top thereof; and a male peripheral sealing projection extends around an inner perimeter of said first wall, wherein said female peripheral sealing cavity is sized to receive said male-_peripheralsealing projection.

3. The storage container of claim 1 wherein:

said vertical peripheral wall is preferably tapered, such that a smallest perimeter dimension is at a bottom of said vertical peripheral wall and a largest perimeter dimension is at a top of said vertical peripheral wall.

4. The storage container of claim 1 wherein:

a shape of said container portion includes a substantially rectangular shape with four curved corners; and a shape of said lid includes a substantially rectangular shape with four curved corners.

5. The storage container of claim 1 wherein:

at least one lift tab extends from one corner of a top outer edge of said male peripheral sealing projection.

6. The storage container of claim 1 wherein:

a peripheral retention cavity is formed in an inner side wall of said female peripheral sealing cavity, a peripheral retention projection is formed on an outside surface of an inner side wall of said male peripheral sealing projection.

7. The storage container of claim 1 wherein:

said first wall tapers inward from said bottom wall, said second wall tapers outward from said bottom wall.

* * * * *